US009663850B2

(12) United States Patent
Ha et al.

(10) Patent No.: US 9,663,850 B2
(45) Date of Patent: May 30, 2017

(54) HIGH-PERFORMANCE HIGH-NITROGEN DUPLEX STAINLESS STEELS EXCELLENT IN PITTING CORROSION RESISTANCE

(71) Applicant: KOREA INSTITUTE OF MACHINERY AND MATERIALS, Daejeon (KR)

(72) Inventors: Heon Young Ha, Changwon-si (KR); Tae-Ho Lee, Masan-si (KR); Byoung Chul Hwang, Changwon-si (KR)

(73) Assignee: Korea Institute of Machinery and Materials, Daejeon (KR)

( * ) Notice: Subject to any disclaimer, the term of this patent is extended or adjusted under 35 U.S.C. 154(b) by 365 days.

(21) Appl. No.: 14/251,349

(22) Filed: Apr. 11, 2014

(65) Prior Publication Data

US 2014/0219857 A1 Aug. 7, 2014

Related U.S. Application Data

(63) Continuation of application No. PCT/KR2013/000619, filed on Jan. 25, 2013.

(30) Foreign Application Priority Data

Jan. 31, 2012 (KR) ..... 10-2012-0009787
Jan. 31, 2012 (KR) ..... 10-2012-0009794

(51) Int. Cl.

| | |
|---|---|
| ***C22C 38/58*** | (2006.01) |
| ***C22C 38/22*** | (2006.01) |
| ***C22C 38/38*** | (2006.01) |
| ***C22C 38/44*** | (2006.01) |
| ***C22C 38/00*** | (2006.01) |
| ***C22C 38/02*** | (2006.01) |
| ***C21D 6/00*** | (2006.01) |

(52) U.S. Cl.

CPC ..... *C22C 38/58* (2013.01); *C21D 6/002* (2013.01); *C22C 38/001* (2013.01); *C22C 38/002* (2013.01); *C22C 38/02* (2013.01); *C22C 38/22* (2013.01); *C22C 38/38* (2013.01); *C22C 38/44* (2013.01); *C21D 2211/001* (2013.01); *C21D 2211/005* (2013.01)

(58) Field of Classification Search

CPC ..... C22C 38/001; C22C 38/002; C22C 38/02; C22C 38/22; C22C 38/38; C22C 38/44; C22C 38/58; C21D 6/002; C21D 2211/001; C21D 2211/005

See application file for complete search history.

(56) References Cited

U.S. PATENT DOCUMENTS

2009/0098007 A1* 4/2009 Tsuge ..... C21C 5/005 420/38

FOREIGN PATENT DOCUMENTS

| | | | |
|---|---|---|---|
| JP | 10-183303 | | 4/1998 |
| JP | 2000239799 A | * | 9/2000 |
| JP | 03798317 | | 7/2006 |
| JP | 2006-233308 | | 9/2006 |
| KR | 10-2010-0133487 | | 12/2010 |
| KR | 10-2011-0006044 | | 1/2011 |
| WO | WO 01/00897 | | 1/2001 |
| WO | WO 2009/138570 | | 11/2009 |

OTHER PUBLICATIONS

Koga et al., English machine translation of JP 2000-239799, Sep. 2000, p. 1-10.*
Bramfitt, B.L., "Role of Microstructure", Metals Handbook Desk Edition, 1998, ASM International, p. 1-41.*
International Search Report mailed May 9, 2013, for International Application No. PCT/KR2013/000619 (English translation).

* cited by examiner

*Primary Examiner* — Roy King
*Assistant Examiner* — Caitlin Kiechle
(74) *Attorney, Agent, or Firm* — Lathrop & Gage LLP

(57) ABSTRACT

The present invention relates to high-nitrogen duplex stainless steels with an excellent eco-index and pitting corrosion resistance, in particular, to providing duplex stainless steels with ferrite-austenite phases, including: 16.5-19.5 wt. % of chromium (Cr), 2.3-3.5 wt. % of molybdenum (Mo), 1.0-5.5 wt. % of tungsten (W), 5.5-7.0 wt. % of manganese (Mn), 0.35-0.45 wt. % of nitrogen (N), with a remainder of iron (Fe). The high nitrogen duplex stainless steels with excellent eco-index and pitting corrosion resistance according to the present invention use manganese (Mn) and nitrogen (N) to exclude or mostly substitute Ni, which increases price instability of the steel grades and environment burden, to result in enhancing economic efficiency, price stability and eco-friendliness.

9 Claims, 2 Drawing Sheets

HIGH-PERFORMANCE HIGH-NITROGEN DUPLEX STAINLESS STEELS EXCELLENT IN PITTING CORROSION RESISTANCE

CROSS-REFERENCE TO RELATED APPLICATIONS

This patent application is a continuation of International Application No. PCT/KR2013/000619 filed on Jan. 25, 2013, which claims the benefit of priority from Korean Patent Applications Nos. 10-2012-0009787 and 10-2012-0009794, filed each on Jan. 31, 2012, in the Korean Intellectual Property Office, the disclosures of which are incorporated herein by reference in their entireties.

BACKGROUND

1. Field of the Invention

The present invention relates to high-performance high-nitrogen duplex stainless steels excellent in pitting corrosion resistance.

2. Description of the Related Art

Ni-dependent austenitic stainless steels are used in general corrosive environments and are the grades that occupy the largest market share by taking up about 60% of total stainless steel use. Nickel (Ni) is essentially required as an austenitic phase stabilizer, but due to high price and price fluctuation thereof, it is difficult to keep stable balance between supply and demands. To solve this problem, researchers have actively studied the ways to improve economic feasibility by finding appropriate low-Ni or Ni-free stainless steels as the replacement for the austenite stainless steels.

Duplex stainless steels are the grades that contain finely balanced ferritic and austenitic phase ratio of about 50:50. Compared to the austenite stainless steels, the duplex stainless steels have higher price competitiveness as these need less Ni content, and can be used in a wider range of applications by controlling alloying composition and microstructures. Considering the above-mentioned advantages, studies are conducted on the duplex stainless steels as the replacement for the Ni-dependent stainless steels.

Among the duplex stainless steels, lean duplex stainless steels with further reduced Ni content have been researched and developed, and some grades have been commercialized as the replacements for the previously-used austenitic stainless steels. Examples of lean duplex stainless steels that have been developed are: lean duplex 2304 (UNS 532304) containing 23% chromium (Cr), and 4% nickel (Ni), and LDX2101 (21% Cr, 1% Ni, UNS 532101) having reduced Ni content (down to 1%), but comparable corrosion resistance to that of AISI 316 L stainless steels and even better strength and elongation level than AISI 316 L.

However, because the duplex stainless steels contain approximately 50 vol % ferritic phase which has nitrogen solubility as low as 0.04% by weight or lower, it is not easy to increase nitrogen (N) content in the stainless steels. As the nitrogen solid solution in the basic materials of the duplex stainless steel is firstly incorporated in the austenitic phase, chemical composition of austenitic and ferritic phases deviates from equilibrium due to presence of excess of nitrogen (N) solid solution in the austenitic phase. Further, the formation of Cr—N bonding and precipitates are detrimental to mechanical-chemical properties of the stainless steels. The above drawbacks confine further development and commercialization of high-N duplex stainless steels that actively utilize nitrogen (N), and an appropriate solution is necessary.

Accordingly, after studying the duplex stainless steels having ferritic and austenitic phase having variable range of properties, the present inventors developed compositions for low Ni, high N duplex stainless steels, which utilize manganese (Mn) and nitrogen (N) to stabilize the austenitic phase and thus reduce or eliminate Ni use, and utilize molybdenum (Mo) and tungsten (W) to provide corrosion resistance that is comparable to, or greater than that of the currently used austenitic stainless steels and duplex stainless steels, and have optimum combination of alloying elements to thus exhibit greatly improved mechanical characteristics than the currently available austenitic stainless steels and duplex stainless steels.

TECHNICAL PROBLEM

It is an object of the present invention to provide high-performance high-nitrogen duplex stainless steels which are excellent in pitting corrosion resistance.

TECHNICAL SOLUTION

To achieve the objective above, the present invention provides duplex stainless steels with ferrite-austenite phases, comprising:

16.5-19.5 wt. % of chromium (Cr), 2.3-3.5 wt. % of molybdenum (Mo), 1.0-5.5 wt. % of tungsten (W), 5.5-7.0 wt. % of manganese (Mn), 0.35-0.45 wt. % of nitrogen (N), with a remainder of iron (Fe) and unavoidable impurities including 0.03 wt. % or less of carbon (C) and 0.5 wt. % or less of silicon (Si).

ADVANTAGEOUS EFFECTS

The high nitrogen duplex stainless steels with excellent pitting corrosion resistance according to the present invention use manganese (Mn) and nitrogen (N) to exclude or mostly substitute nickel (Ni), which increases price instability of the steel grades and environment liability, in which the developed duplex stainless steels can provide enhanced economic efficiency, price stability and eco-friendliness.

In addition, because of properly designed content of nitrogen (N) in the range of 0.35 to 0.45 wt. %, several advantages over the conventional high nitrogen stainless steels are provided, which include: (1) reduced burden of pressing $N_2$ during fabrication; (2) reduced energy consumption during the fabrication process due to the decreased temperature to 1100° C. or less for the hot rolling and solution treatment process; (3) enhanced mechanical property and corrosion resistance due to suppressed formation of precipitates that can occur due to excessive solutionized N; (4) effective enhancement in corrosion resistance due to reduced use of manganese (Mn) to increase N solid solubility; (5) additionally improved corrosion resistance due to the reduced tendency of alloy element partitioning between the ferrite and the austenite phases and accordingly suppressed pitting growth by micro-galvanic corrosion; and (6) combination of superior strength and ductility.

Furthermore, the duplex stainless steels according to the present invention have an advantage of high price stability compared to the conventional austenite stainless steels for general corrosion resistant environment by including a small amount of nickel (Ni) of 0.7 wt. % or less.

The duplex stainless steels according to the present invention have superior mechanical properties to the commercial austenite stainless steels, while maintaining the equivalent and/or superior level of corrosion resistance compared to the austenitic stainless steels for use in the general corrosion resistant environment. Thus, the duplex stainless steels may substitute for the commercial austenitic stainless steels for use in the general corrosion resistant environment, and may be used as a container, or a frame member for transportation vehicle, structural material, or steel pipe/tube materials for paper industry, marine, chemical process, refinery, power generation industries, or high value-added material for bio adaptable area, etc. In addition, the duplex stainless steels according to the present invention may be fabricated as materials in a form of tube, wire, strip, rod, sheet, bar or others which requires high strength and high elongation properties.

MODE FOR INVENTION

Figure 1:
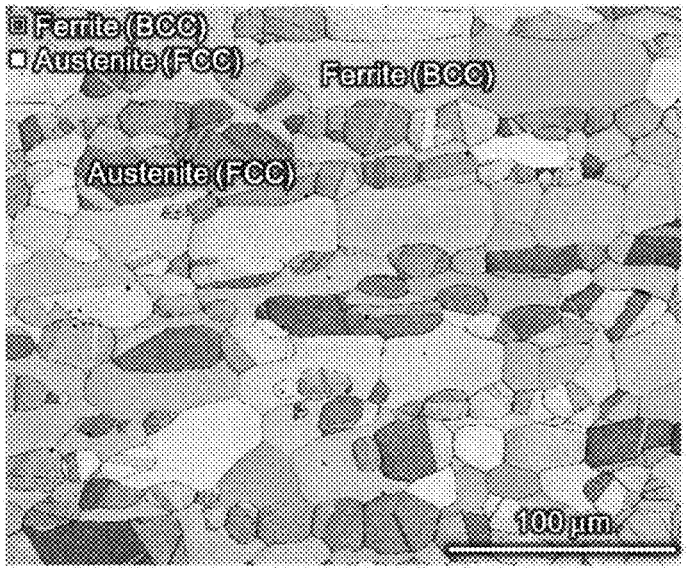
FIG. 1 is an electron backscattered diffraction (EBSD) image of microstructure and orientations of the respective crystal grains of the duplex stainless steels according to the present invention.

According to the present invention, duplex stainless steels with ferrite-austenite phases are provided, which include 16.5-19.5 wt. % of chromium (Cr), 2.5-3.5 wt. % of molybdenum (Mo), 1.0-5.5 wt. % of tungsten (W), 5.5-7.0 wt. % of manganese (Mn), 0.35-0.45 wt. % of nitrogen (N), with a remainder of iron (Fe) and unavoidable impurities including 0.03 wt. % or less of carbon (C) and 0.5 wt. % or less of silicon (Si).

The duplex stainless steels according to the present invention may additionally include 0.01 to 0.7 wt. % of nickel (Ni).

By additionally including 0.01 to 0.7 wt. % of nickel (Ni), the duplex stainless steels can have noble austenite phase, and maintain high solutionized N during ingot quenching.

The duplex stainless steels may exclude nickel (Ni).

Further, the duplex stainless steels may include 16.5-19.5 wt. % of chromium (Cr), 2.5-3.5 wt. % of molybdenum (Mo), 1.0-5.5 wt. % of tungsten (W), 5.5-7.0 wt. % of manganese (Mn), 0.35-0.45 wt. % of nitrogen (N), with a remainder of iron (Fe) and unavoidable impurities including 0.03 wt. % or less of carbon (C) and 0.5 wt. % or less of silicon (Si).

According to the present invention, the duplex stainless steels include 0.35-0.45 wt. % N as a replacement for Ni which has unstable price problem and detrimental to environment and human health, and include 5.5 wt. % or more Mn to stabilize austenite phase economically.

Also, because use of Ni is reduced, price for steel grades is further stabilized, and environmental liability is also reduced, compared to austenite stainless steels for general corrosion environment.

Further, because Cr content is reduced to below 19.5 wt. %, material cost can be reduced (i.e., provided as lean type), and ferrite phase is stabilized because precipitation of sigma (o) phase due to high Cr content is suppressed. Molybdenum (Mo) and tungsten (W) stabilize ferrite phase and these also can provide superior corrosion resistance. To be specific, W can be a replacement for Mo, because W has similar ferrite stabilizing and corrosion resistance enhancing properties to Mo, while W has lower tendency to form σ phase precipitation which is detrimental to mechanic characteristics and corrosion resistance.

The duplex stainless steels according to the present invention may preferably include 40 to 60% volume fraction of ferrite phase. With ferrite phase under 40% volume fraction, strength and resistance to stress corrosion cracking (SCC) degrade, while with ferrite phase above 60% volume fraction, elongation degrades due to decreased austenite phase volume fraction. Hereinafter, the main alloying elements of the duplex stainless steels according to the present invention will be described in detail.

(1) Chromium (Cr)

Chromium (Cr) is a ferrite stabilizer and is essentially required for the corrosion resistance of the stainless steels. Because Cr increases solubility of nitrogen (N), at least 16.5 wt. % Cr was added to the duplex stainless steels to ensure corrosion resistance of the steel grades and to increase N solubility. However, with excess Cr, surplus delta ferritic phase remains after solidification, and formation of sigma (σ) phase is facilitated in the duplex stainless steels. Because the presence of delta ferritic phase and sigma (σ) phase precipitates degrade pitting corrosion resistance of the steels, Cr content was limited to a range of 16.5-19.5 wt. %.

(2) Molybdenum (Mo)

Molybdenum (Mo) is a ferritic phase stabilizer and it greatly improves general and localized corrosion resistances against reductive acidic solution and chloride ($Cl^-$) solution. When added in combination with nitrogen (N), Mo exhibits synergistic effect of further promoting pitting corrosion resistance. According to the present invention, at least 2.5 wt. % Mo was added to the duplex stainless steels to increase pitting corrosion resistance of the alloy. However, presence of excess Mo increases fraction of the remaining delta ferritic phase after solidification, and like the case of Cr, forms detrimental sigma (σ) phase to thus deteriorate the properties of the steels. Further, considering noneconomic price of Mo, Mo was limited to below 3.5 wt. % to ensure economic benefit.

(3) Tungsten (W)

Among alloying elements of the stainless steels, tungsten (W) acts similarly as Mo (that is, it stabilizes ferritic phase, enhances corrosion resistance, etc.), and is available at more competitive price than Mo. Accordingly, W is used as a substitute for Mo. Compared to Mo, W has lower sigma (σ) phase forming activity and thus can prevent deterioration of mechanic characteristics and corrosion resistance due to presence of secondary phase precipitation. Furthermore, it is possible to improve low temperature impact strength of the alloy by replacing Mo by W. Accordingly, the duplex stainless steels according to the present invention included both Mo and W, while partially replacing Mo content with W content. The W content was limited to a range of 1.0-5.5 wt. %.

(4) Nickel (Ni)

Nickel (Ni) is a representative austenitic phase stabilizer, but Ni content is strictly limited due to fluctuating price range and its harmful effect on environment and human health. However, Ni improves hot and/or cold formability and provides high stress corrosion cracking (SCC) resistance and also superior corrosion resistance in acidic solution. The Ni content also provides advantage of inhibiting delta ferrite formation in the solidification process. Accordingly, for the duplex stainless steels according to the present invention, the Ni addition is set to be a content range of 0.07-0.7 wt. % or none.

(5) Manganese (Mn)

Manganese (Mn) is an economic austenitic phase stabilizer and can be added as a replacement for Ni which is also an austenitic phase stabilizer but is expensive. Because Mn increases N solubility in the steel grades, Mn content can improve strength of the stainless steels. According to the present invention, at least 5.5 wt. % Mn is added to the duplex stainless steels to increase economic feature of the steel grades and also to increase N solubility. However, presence of excess Mn can bind to impurity such as sulfur (S) or oxygen (O), thus forming into nonmetallic inclusion such as MnS or MnO. Because the nonmetallic inclusion causes pitting to occur, which will deteriorate pitting corrosion resistance of the stainless steels, the Mn content was limited to 7.0 wt % or less.

(6) Nitrogen (N)

Like Mn, nitrogen (N) can be used as an effective replacement for nickel (Ni) as this is a powerful austenitic stabilizer. Nitrogen (N) increases the strength of the stainless steels, and at the same time, maintains a high level of ductility, and greatly promotes the pitting corrosion resistance. According to the present invention, the duplex stainless steels provide excellent strength-ductility combination (Eco index) and pitting corrosion resistance, by alloying at least 0.35 wt. % N. However, the presence of excess N forms nitrides which cause problems such as embrittlement of the steels and formation of pore in the cast material. To prevent these problems, the duplex stainless steels according to the present invention have nitrogen (N) content limited to 0.35-0.45 wt. %.

(7) Carbon (C) and Silicon (Si)

Carbon (C) is an interstitial element with similar atomic size to nitrogen (N). It stabilizes austenite phase, and provides advantage of enhanced strength of the steel material. However, at high temperature, carbon (C) easily bonds with chromium (Cr), the main alloy element of the stainless steels to form stable Cr-carbide ($Cr_{23}C_6$, etc.). The Cr-carbides precipitate at the grain boundary, consuming chromium (Cr) in the adjacent matrix and generate Cr-depletion zone around the Cr-carbide precipitates. The pitting corrosion is easily initiated at the Cr-depleted zone. Therefore, the duplex stainless steels according to the present invention includes limited carbon (C) content to 0.03 wt. % or less.

Meanwhile, silicon (Si) is a ferrite phase former and is mainly used as deoxidizer in the steelmaking process, because it easily bonds to oxygen (O) in the base metal. However, excessive silicon (Si) content considerably degrades the mechanical properties related to toughness, and forms intermetallic compounds. Accordingly, the duplex stainless steels according to the present invention includes limited silicon (Si) content to 0.5 wt. % or less.

(8) Ferrite Phase

To ensure superior strength and stress corrosion cracking (SCC) resistance and enhanced weldability, the duplex stainless steels according to the present invention maintain the volume fraction of ferrite phase to 40% or more. However, because the excessive ferrite fraction deteriorates the low temperature impact toughness and the resistance against hydrogen embrittlement, the volume fraction of ferrite phase is limited so that it does not exceed 60%.

The duplex stainless steels according to the present invention show the tensile strength (TS) of 826-933 MPa, the yield strength (YS) of 574-640 MPa, and elongation of 26-51%, and show superior characteristic of Eco-index of 24,000 MPa•% or higher, which is the product of tensile strength and uniform elongation.

The eco-index (ecological index of performance) of steel material is the indicator quantifying superior sustainability among various eco-friendly characteristics required for the advanced (future-type) steel material, which is defined as the product of multiplying tensile strength (MPa) by uniform elongation (%).

In addition, the duplex stainless steels according to the present invention show equal or superior pitting corrosion resistance compared to that of the commercial austenite stainless steels of 300 series (UNS S30400, UNS S31603) for use in general corrosion resistant environment and that of the commercial duplex austenite stainless steels (UNS S32304). The fact that the mechanical properties of the duplex stainless steels according to the present invention exceed the values of tensile strength, yield strength and elongation of the conventional commercial austenitic stainless steels and the duplex stainless steels, and have superior pitting corrosion resistance confirms the superiority of the duplex stainless steels according to the present invention.

Exemplary embodiments and examples of the present invention will be explained in greater detail below. However, it should be understood that the embodiments and examples are explained only for the illustrative purpose, and therefore, the concept of the present invention is not limited by the exemplary embodiments.

Examples 1-7 Fabrication of Duplex Stainless Steels

The master alloys of electrolytic iron, Fe—Cr, Fe—Mn, Fe—Mo and nickel (Ni), tungsten (W) were adjusted to the composition ratio according to the composition in Example 1 to Example 7 of Table 1, charged respectively to vacuum induction melting furnace (VIM 4III-P, ALD, Germany)) to melt completely, and nitrogen ($N_2$) gas was introduced to prepare 10 kg ingot. The prepared ingot of 40 mm in thickness was homogenized at 1300° C. for 2 hours, and then hot rolled to the final thickness of 4 mm at 1050° C. or higher, by at least one pass with 40% or greater reduction ratio in thickness. The water quenching was conducted after the hot rolling, to prevent formation of precipitation, and as a result, the duplex stainless steels were prepared according to the present invention.

Comparative Examples 1-4

Comparative Examples 1-4 are commercial austenite stainless steels of 304 stainless steel (UNS S30400) and 316 L stainless steel (UNS S31603), commercial duplex austenite stainless steels of 2304 stainless steel (UNS S32304) and 2205 stainless steel (UNS S31803).

The compositions of the duplex stainless steels fabricated in the Examples 1 to 7 and the commercial stainless steels are shown in Table 1 as below.

TABLE 1

| wt. % | Cr | Ni | Mn | Mo | W | N | C | O | P | Si |
|---|---|---|---|---|---|---|---|---|---|---|
| Ex. 1 | 19.4 | None | 6.2 | 3.0 | 2.1 | 0.40 | 0.020 | 0.016 | 0.008 | 0.372 |
| Ex. 2 | 19.2 | None | 6.2 | 2.7 | 1.0 | 0.37 | 0.017 | 0.015 | 0.009 | 0.409 |
| Ex. 3 | 18.4 | None | 6.6 | 3.0 | 3.0 | 0.42 | 0.013 | 0.015 | 0.008 | 0.334 |
| Ex. 4 | 17.2 | None | 5.9 | 2.5 | 5.0 | 0.43 | 0.012 | 0.011 | 0.008 | 0.310 |
| Ex. 5 | 19.2 | 0.57 | 6.2 | 3.0 | 1.09 | 0.4 | 0.0137 | 0.0085 | 0.009 | 0.376 |
| Ex. 6 | 17.9 | 0.57 | 6.6 | 2.9 | 3.09 | 0.42 | 0.0124 | 0.012 | 0.0083 | 0.370 |
| Ex. 7 | 17.24 | 0.50 | 6.0 | 2.5 | 5.27 | 0.41 | 0.0161 | 0.0072 | 0.326 | 0.372 |
| Comp. 1 | 17.5-19.5 | 8.0-12.0 | 2.0 max. | — | — | 0.10 max. | 0.08 max. | Minute amount | Minute amount | <0.003 |
| Comp. 2 | 16.0-18.0 | 10.0-14.0 | 2.0 max. | 2.0-3.0 | — | 0.050 max | 0.03 max. | Minute amount | Minute amount | <0.003 |
| Comp. 3 | 21.5-24.5 | 3.0-5.5 | 2.5 | 0.05-0.6 | — | 0.05-0.20 | 0.020 | Minute amount | Minute amount | 0.001 |
| Comp. 4 | 21.0-23.0 | 4.5-6.5 | 2 | 2.5-3.5 | — | 0.08-0.20 | 0.03 | Minute amount | Minute amount | 0.003 |

Experimental Example 1 Microstructure and Crystal Structure Analysis

To analyze the microstructure and crystal structure of the duplex stainless steels according to the present invention, electron backscattered diffraction (EBSD) analysis was conducted, and the result is shown in Table 2 and FIG. 1 as below.

TABLE 2

| | Microstructure bcc:fcc |
|---|---|
| Ex. 1 | 48:52 |
| Ex. 2 | 47:53 |
| Ex. 3 | 41:59 |
| Ex. 4 | 42:58 |
| Ex. 5 | 45:55 |
| Ex. 6 | 44:56 |
| Ex. 7 | 43:57 |
| Comp. 1 | Fcc |
| Comp. 2 | Fcc |
| Comp. 3 | 50:50 |
| Comp. 4 | 50:50 |

In the microstructure of Table 2 above, 'bcc' refers to ferritic phase and 'fcc' refers to austenitic phase.

As shown in Table 2 and FIG. 1, the duplex stainless steels of Example 1 to Example 7 according to the present invention fulfill the condition of the phase fraction ratio (ferrite: austenite) of 40:60 to 50:50. Additionally, it is shown that the commercial austenite stainless steels of the Comparative Examples 1 to 2 have austenite single phase, and the commercial duplex austenite stainless steels of the Comparative Examples 3 to 4 consist of the phase fraction ratio of ferrite and austenite of about 50:50.

The proper fraction of ferrite phase in the range explained above can provide the superior strength and stress corrosion cracking (SCC), and it can prevent degradation of low temperature impact toughness and resistance to hydrogen embrittlement, which is generally associated with the excessive presence of ferrite phase.

Experimental Example 2 Mechanical Property Analysis

Using a tension tester (model: Instron 5882), the tensile strength, the yield strength and the elongation of the duplex stainless steels of Examples 1 to 7 of the present invention and the commercial stainless steels according to Comparative Examples 1 to 4 were measured and the result is shown in Table 3 and FIG. 2.

TABLE 3

| | Tensile Properties | | | |
|---|---|---|---|---|
| | Yield Strength, YS, MPa | Tensile Strength, TS, MPa | Elongation, El, % | Eco-index TS × El, MPa. % |
| Ex. 1 | 601 | 849 | 44 | 37356 |
| Ex. 2 | 574 | 826 | 51 | 42126 |
| Ex. 3 | 606 | 878 | 49 | 43022 |
| Ex. 4 | 635 | 933 | 33 | 30789 |
| Ex. 5 | 590 | 850 | 49 | 41650 |
| Ex. 6 | 600 | 863 | 40 | 34520 |
| Ex. 7 | 640 | 927 | 26 | 24102 |
| Comp. 1 | 205 | 515 | 40 | 20600 |
| Comp. 2 | 170 | 485 | 40 | 19400 |
| Comp. 3 | 400 | 630 | 25 | 15750 |
| Comp. 4 | 450 | 680 | 25 | 17000 |

Figure 2:
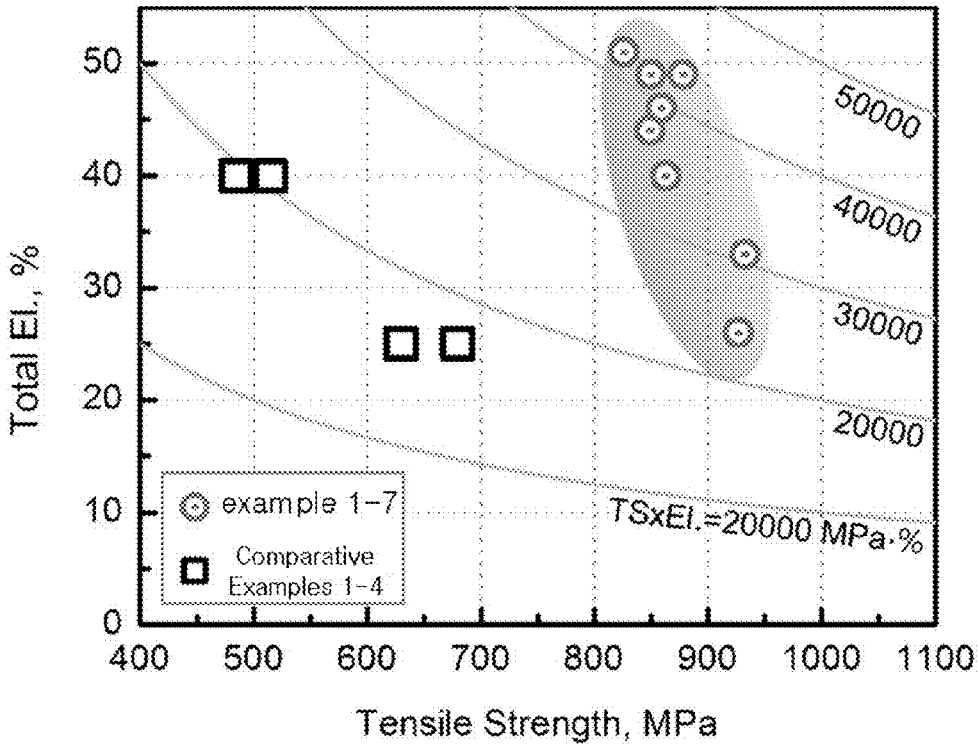
FIG. 2 is a graphical representation of the comparison of the mechanical properties (tensile strength×elongation) among commercial austenitic stainless steels and commercial duplex stainless steels, and the duplex stainless steels according to the present invention.

As shown in Table 3 and FIG. 2, the commercial austenitic stainless steels of Comparative Example 1 and Comparative Example 2 showed the yield strength of 170 to 205 MPa, the tensile strength of 485 to 515 MPa and elongation of 40%, and the commercial duplex austenitic stainless steels of Comparative Example 3 and Comparative Example 4 showed the yield strength of 400 or 450 MPa, the tensile strength of 630 to 680 MPa, and elongation of 25%. Thus, the commercial stainless steels of Comparative Example 1 to Comparative Example 4 show the Eco-index at the level of 15750-20600 MPa·%. In contrast, Examples 1 to 7, the two-phase stainless steels of Examples 1 to 7 according to the present invention show the tensile strength (TS) of 826 to 933 MPa, the yield strength (YS) of 574 to 640 MPa and elongation (%) of 26 to 51%. Therefore, the Eco Index, which is the product of the tensile strength and elongation, is in the range of 24102 to 43022 MPa.%, which is much higher than the commercial stainless steels used in the Comparative Example.

Based on the above, the duplex stainless steels according to the present invention showed the superior composition by securing appropriate level of austenite matrix and sufficiently high strength and elongation ratio, despite no or lower amount of nickel (Ni) used therein compared to commercial duplex stainless steels and austenite stainless steel.

Experimental Example 3 Pitting Corrosion Resistance Test

Figure 3:
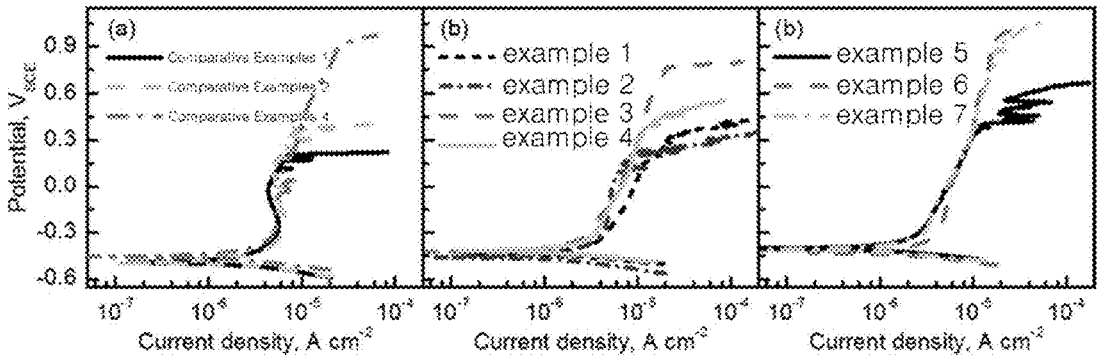
FIG. 3 is a graphical representation of the comparison of pitting corrosion resistance level among commercial austenitic stainless steels and commercial duplex stainless steels, and the duplex stainless steels according to the present invention.

To measure the pitting corrosion resistance of the duplex stainless steels fabricated according to the Examples 1 to 7 of the present invention and the commercial stainless steels of Comparative Examples 1 to 4, the alloy specimens of the Examples and the Comparative Examples were immersed in 1 M NaCl solution at the room temperature, to observe the anodic polarization behaviors while increasing the potential to a potential scan rate (dV/dt) of 3 mV/s, and the polarization test result is shown in FIG. 3.

Additionally, Table 4 shows the pitting potential of each alloy in the polarization test.

TABLE 4

| | Pitting Potential, $E_{pit}$ $V_{SCE}$ |
|---|---|
| Ex. 1 | 0.3216 |
| Ex. 2 | 0.2424 |
| Ex. 3 | 0.4373 |
| Ex. 4 | 0.7830 |
| Ex. 5 | 0.5668 |
| Ex. 6 | no pitting |
| Ex. 7 | no pitting |
| Comp. 1 | 0.1967 |
| Comp. 2 | 0.3733 |
| Comp. 4 | no pitting |

As shown in FIG. 3 and Table 4, the pitting of the commercial austenitic stainless steels occurs at 0.1967 to 0.3733 $V_{SCE}$, while the commercial duplex stainless steels, 2205 stainless steel, did not show pitting corrosion at the condition of this Experimental Example. Meanwhile, the duplex stainless steels fabricated according to Example 1 to Example 5 of the present invention showed pitting corrosion at the potential higher than 0.2424 $V_{SCE}$, or did not show pitting corrosion. Additionally, the duplex stainless steels fabricated according to Example 6 and Example 7 did not show pitting corrosion in this chloride atmosphere. Therefore, it was confirmed that all the duplex stainless steels of the present invention have superior pitting corrosion resistance compared to the commercial austenitic stainless steels for use in general corrosion resistant environment at this chloride atmosphere, especially, the pitting corrosion resistance of the duplex stainless steels having minute amount of nickel showed the equivalent level of the pitting corrosion resistance of the commercial duplex stainless steels.

We claim:

1. Duplex stainless steels with ferrite-austenite phases, comprising 16.5-19.5 wt. % of chromium (Cr), 2.5-3.5 wt. % of molybdenum (Mo), 2.1-5.5 wt. % of tungsten (W), 5.5-7.0 wt. % of manganese (Mn), 0.35-0.45 wt. % of nitrogen (N), 0.01 to 0.7 wt. % of nickel (Ni), with a remainder of iron (Fe) and unavoidable impurities including 0.03 wt. % or less of carbon (C) and 0.5 wt. % or less of silicon (Si).

2. The duplex stainless steels as set forth in claim 1, having 40 to 60% volume fraction of ferrite phase.

3. The duplex stainless steels as set forth in claim 1, having tensile strength of 820 MPa or above, and elongation of 25% or above, and wherein a product of multiplying the tensile strength by the elongation is 24000 MPa•% or above.

4. Duplex stainless steels with ferrite-austenite phases, comprising 16.5-19.5 wt. % of chromium (Cr), 2.5-3.5 wt. % of molybdenum (Mo), 2.1-5.5 wt. % of tungsten (W), 5.5-7.0 wt. % of manganese (Mn), 0.35-0.45 wt. % of nitrogen (N), excluding nickel (Ni), with a remainder of iron (Fe) and unavoidable impurities including 0.03 wt. % or less of carbon (C) and 0.5 wt. % or less of silicon (Si).

5. The duplex stainless steels as set forth in claim 4, having 40 to 60% volume fraction of ferrite phase.

6. The duplex stainless steels as set forth in claim 4, having tensile strength of 820 MPa or above, and elongation of 25% or above, and wherein a product of multiplying the tensile strength by the elongation is 24000 MPa•% or above.

7. Duplex stainless steels with ferrite-austenite phases, consisting of 16.5-19.5 wt. % of chromium (Cr), 2.5-3.5 wt. % of molybdenum (Mo), 2.1-5.5 wt. % of tungsten (W), 5.5-7.0 wt. % of manganese (Mn), 0.35-0.45 wt. % of nitrogen (N), with a remainder of iron (Fe) and unavoidable impurities including 0.03 wt. % or less of carbon (C) and 0.5 wt. % or less of silicon (Si).

8. The duplex stainless steels as set forth in claim 7, having 40 to 60% volume fraction of ferrite phase.

9. The duplex stainless steels as set forth in claim 7, having tensile strength of 820 MPa or above, and elongation of 25% or above, and wherein a product of multiplying the tensile strength by the elongation is 24000 MPa•% or above.

* * * * *